US007784247B2

(12) United States Patent
Konno

(10) Patent No.: US 7,784,247 B2
(45) Date of Patent: Aug. 31, 2010

(54) PACKAGING-CONTAINER MANUFACTURING APPARATUS AND PACKAGING-CONTAINER MANUFACTURING METHOD

(75) Inventor: Hidetoshi Konno, Tokyo (JP)

(73) Assignee: Tetra Laval Holdings & Finance S.A. (CH)

( * ) Notice: Subject to any disclaimer, the term of this patent is extended or adjusted under 35 U.S.C. 154(b) by 350 days.

(21) Appl. No.: 12/085,308

(22) PCT Filed: Dec. 1, 2006

(86) PCT No.: PCT/JP2006/324091

§ 371 (c)(1),
(2), (4) Date: May 21, 2008

(87) PCT Pub. No.: WO2007/072673

PCT Pub. Date: Jun. 28, 2007

(65) Prior Publication Data

US 2009/0293428 A1 Dec. 3, 2009

(30) Foreign Application Priority Data

Dec. 22, 2005 (JP) ..... 2005-370211

(51) Int. Cl.
*B65B 61/00* (2006.01)

(52) U.S. Cl. ..... 53/415; 53/135.3; 53/451; 53/551

(58) Field of Classification Search ..... 53/135.3, 53/415, 451, 551, 552
See application file for complete search history.

(56) References Cited

U.S. PATENT DOCUMENTS

| | | | | |
|---|---|---|---|---|
| 2,078,669 | A | 4/1937 | King | |
| 4,077,579 | A * | 3/1978 | Seleski et al. | 242/563.1 |
| 4,146,797 | A * | 3/1979 | Nakagawa | 250/548 |
| 4,859,860 | A * | 8/1989 | Poterala | 250/548 |
| 5,369,936 | A * | 12/1994 | Callahan et al. | 53/415 |
| 5,554,262 | A * | 9/1996 | Turner | 162/198 |
| 6,460,748 | B1 | 10/2002 | Boschi | 226/20 |
| 6,666,002 | B1 * | 12/2003 | Otsuka et al. | 53/426 |
| 7,222,472 | B2 * | 5/2007 | Spatafora et al. | 53/505 |

(Continued)

FOREIGN PATENT DOCUMENTS

| | | |
|---|---|---|
| EP | 0517928 | 12/1992 |

(Continued)

*Primary Examiner*—Thanh K Truong
(74) *Attorney, Agent, or Firm*—Bacon & Thomas, PLLC

(57) ABSTRACT

An object is to enable a strip tape to be bonded to a packaging material at a proper position and enable longitudinal sealing to be performed well. A packaging-container manufacturing apparatus includes a bonding member, a first detection section which detects an edge of the packaging material, a second detection section which detects an edge of the strip tape (12), position determination processing means for determining the position of the strip tape (12) in relation to the packaging material, and position correction processing means for correcting the position of the strip tape (12) in relation to the packaging material. Since the position of the strip tape (12) in relation to the packaging material is determined on the basis of outputs of the first and second detection sections and the position of the strip tape (12) in relation to the packaging material is corrected on the basis of results of the determination on the position, the strip tape (12) is placed on the packaging material at a proper position.

5 Claims, 6 Drawing Sheets

U.S. PATENT DOCUMENTS 7,448,189 B2 * 11/2008 Kinoshita et al. ..... 53/551

FOREIGN PATENT DOCUMENTS

EP 1167206 1/2002
JP H07-315363 12/1995
JP 2001-278360 10/2001
JP 2004-292029 10/2004

* cited by examiner

PACKAGING-CONTAINER MANUFACTURING APPARATUS AND PACKAGING-CONTAINER MANUFACTURING METHOD

TECHNICAL FIELD

The present invention relates to a packaging-container manufacturing apparatus and a packaging-container manufacturing method.

BACKGROUND ART

Conventionally, in a packaging-container manufacturing apparatus which manufactures packaging containers each containing food having fluidity (for example, liquid food) such as milk or juice, a weblike packaging material manufactured by means of a packaging-material manufacturing apparatus is set in the form of a reel in a dispenser section of a filling machine, and is dispensed and transferred through the filling machine in synchronism with supply of a liquid food. The packaging material is a flexible laminate including a paper substrate, and films of polyethylene resin covering opposite surfaces of the paper substrate. When necessary, a barrier layer, formed of aluminum foil, gas barrier resin, or the like, is formed between the paper substrate and the films.

After being dispensed from a dispenser, the packaging material is sealed longitudinally to thereby be formed in a tubular shape, and the liquid food is charged from a supply pipe into a tubular packaging material.

Incidentally, when the packaging material is formed in a tubular shape, opposite edges of the packaging material form steps inside and outside the tubular packaging material. If the liquid food soaks into packaging material from an end surface of the packaging material which forms the inside step as a result of the liquid food being charged into the tubular packaging material, the quality of packaging containers deteriorates.

In order to overcome the above-described problem, an elongated strip tape is bonded across the step so as to prevent the end surface of the packaging material from coming into contact with the liquid food (see, for example, Patent Document 1).

Patent Document 1: Japanese Patent Application Laid-Open (kokai) No. H7-315363.

DISCLOSURE OF THE INVENTION

Problem to be Solved by the Invention

However, the above-mentioned conventional packaging-container manufacturing apparatus cannot perform longitudinal sealing well if the strip tape is not bonded to a proper position.

FIG. 1 is a view showing a conventional reel for dispensing a strip tape; FIG. 2 is a first view showing a waved state of a conventional strip tape; and FIG. 3 is a second view showing another waved state of the conventional strip tape.

In these drawings, reference numeral 12 denotes a strip tape, and reference symbol hd represents a holder for the strip tape 12. The strip tape 12, which is rolled in the form of a reel in the holder hd, is dispensed from the holder hd in the form of web and is bonded to one edge of a conveyed packaging material.

However, since the packaging material is not necessarily cut to have accurate dimensions, in some cases the positions of edges of the conveyed packaging material change. In such a case, the strip tape 12 cannot be bonded to a proper position.

Further, the diameter of the strip tape 12 rolled in the form of a reel (hereinafter referred to as the "reel diameter") changes as the strip tape 12 is dispensed from the holder hd. Such a change in the reel diameter results in a change in tension applied to the strip tape 12. As a result, the position of the strip tape 12 in relation to the packaging material changes, and it becomes impossible to bond the strip tape 12 to a proper position.

Moreover, since the strip tape 12 is formed of thin resin film, as a result of the strip tape 12 being dispensed, one edge of the strip tape 12 extends and waves as shown in FIGS. 2 and 3. In such a case, the strip tape 12 meanders, and bonding the strip tape 12 to a proper position becomes impossible.

An object of the present invention is to solve the above-described problems in the conventional packaging-container manufacturing apparatus and to provide a packaging-container manufacturing apparatus and a packaging-container manufacturing method which enable a strip tape to be bonded to a packaging material at a proper position and enable longitudinal sealing to be performed well.

Means for Solving the Problem

To achieve the above object, a packaging-container manufacturing apparatus of the present invention comprises a bonding member which bonds a strip tape to one edge of a weblike packaging material; a first detection section disposed upstream of the bonding member with respect to a conveyance direction of the packaging material and adapted to detect the edge of the packaging material; a second detection section disposed downstream of the bonding member with respect to the conveyance direction of the packaging material and adapted to detect an edge of the strip tape; position determination processing means for determining the position of the strip tape in relation to the packaging material on the basis of outputs of the first and second detection sections; and position correction processing means for correcting the position of the strip tape in relation to the packaging material on the basis of results of the determination on the position.

In another packaging-container manufacturing apparatus of the present invention, the first detection section is disposed to sandwich the packaging material, and the second detection section is disposed to sandwich the strip tape.

In still another packaging-container manufacturing apparatus, projection-width calculation processing means is provided so as to calculate a projection width, which is the width of a portion of the strip tape projecting from the packaging material, on the basis of the outputs of the first and second detection sections.

The position determination processing means determines the position of the strip tape in relation to the packaging material on the basis of the projection width.

In still another packaging-container manufacturing apparatus, a guide member which guides the strip tape and a drive section which moves the guide member are provided.

The position correction processing means drives the drive section on the basis of the results of the determination on the position.

In a packaging-container manufacturing method of the present invention, a strip tape is bonded to one edge of a weblike packaging material by means of a bonding member.

The method comprises detecting the edge of the packaging material upstream of the bonding member with respect to a conveyance direction of the packaging material; detecting an edge of the strip tape downstream of the bonding member with respect to the conveyance direction of the packaging material; determining the position of the strip tape in relation to the packaging material on the basis of outputs of first and second detection sections; and correcting the position of the strip tape in relation to the packaging material on the basis of results of the determination on the position.

Effects of the Invention

According to the present invention, the packaging-container manufacturing apparatus comprises a bonding member which bonds a strip tape to one edge of a weblike packaging material; a first detection section disposed upstream of the bonding member with respect to a conveyance direction of the packaging material and adapted to detect the edge of the packaging material; a second detection section disposed downstream of the bonding member with respect to the conveyance direction of the packaging material and adapted to detect an edge of the strip tape; position determination processing means for determining the position of the strip tape in relation to the packaging material on the basis of outputs of the first and second detection sections; and position correction processing means for correcting the position of the strip tape in relation to the packaging material on the basis of results of the determination on the position.

In this case, since the position of the strip tape in relation to the packaging material is determined on the basis of outputs of the first and second detection sections and the position of the strip tape in relation to the packaging material is corrected on the basis of results of the determination on the position, the strip tape is placed on the packaging material at a proper position. Therefore, the strip tape can be bonded to the packaging material at a proper position, whereby longitudinal sealing can be performed well.

DESCRIPTION OF REFERENCE NUMERALS

Figure 1:
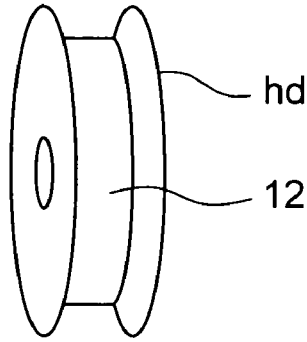
FIG. 1 is a view showing a conventional reel for dispensing a strip tape.
Figure 2:
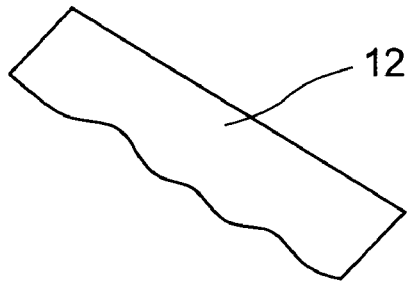
FIG. 2 is a first view showing a waved state of a conventional strip tape.
Figure 3:
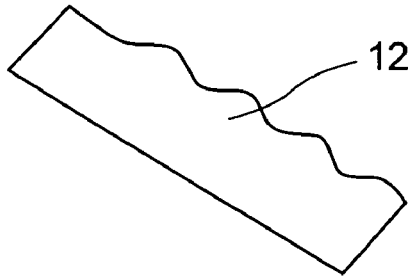
FIG. 3 is a second view showing another waved state of the conventional strip tape.

11: packaging material
12: strip tape
15: press roller
64, r1, r2, ra: guide roller
71: drive section
74, 75: edge sensor

BEST MODE FOR CARRYING OUT THE INVENTION

An embodiment of the present invention will next be described in detail with reference to the drawings.

Figure 4:
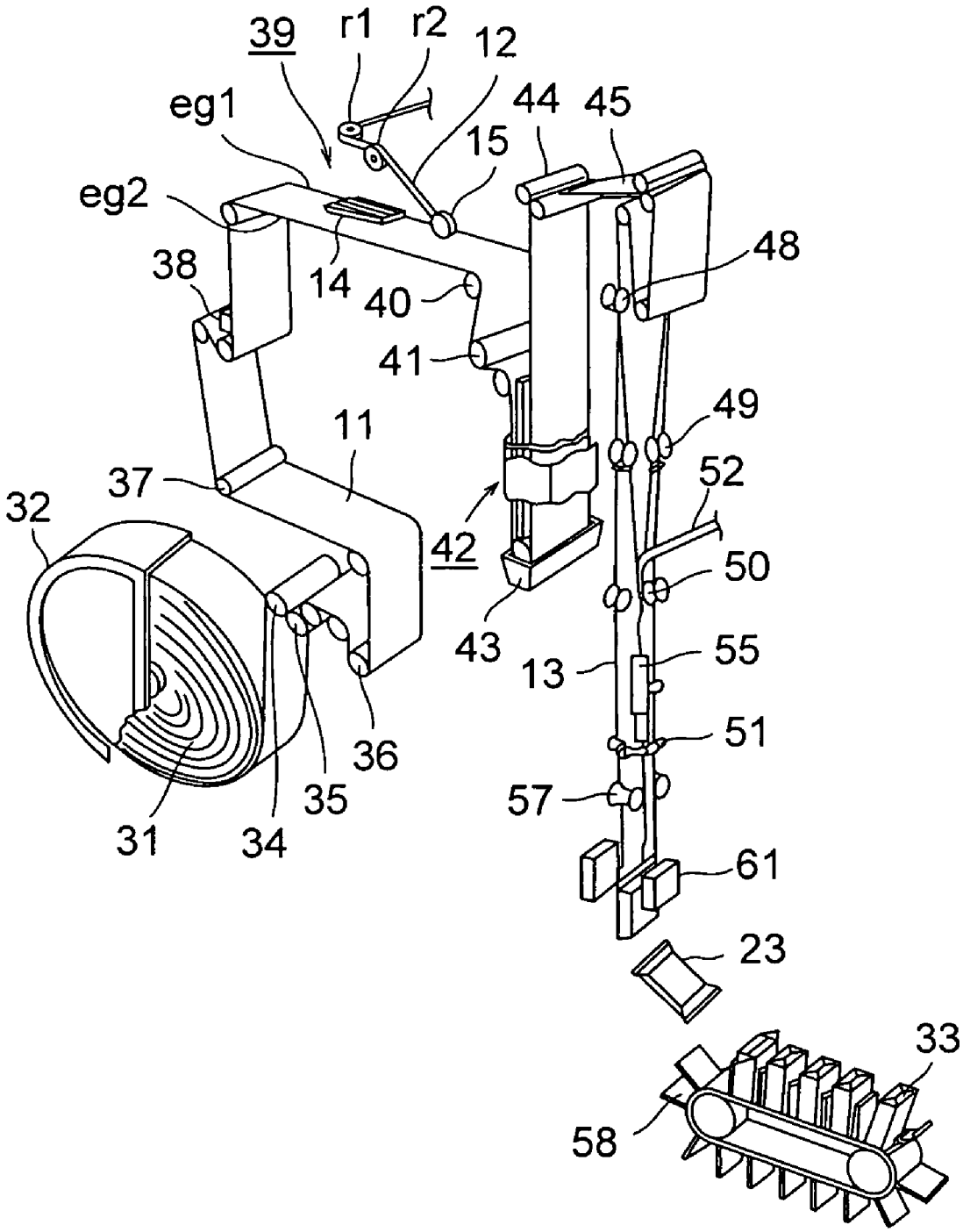
FIG. 4 is a schematic view of a packaging-container manufacturing apparatus according to an embodiment of the present invention.

FIG. 4 is a schematic view of a packaging-container manufacturing apparatus according to an embodiment of the present invention.

In FIG. 4, reference numeral 11 denotes a weblike packaging material. The packaging material 11 is accommodated in a cassette 32 in the form of a reel 31, and is set in an unillustrated dispenser section of a filling machine via the cassette 32. The packaging material 11 has a multilayer structure and includes a paper substrate, an innermost layer serving as a first layer, and an outermost layer serving as a second layer, wherein the innermost and outermost layers are formed by covering the paper substrate with a resin film. When necessary, a gas barrier layer, formed of aluminum foil, gas barrier resin, or the like, may be formed between the paper substrate and the innermost layer. Printing for external facing is provided between the paper substrate and the outermost layer and on the surface of the outermost layer.

The resin film for forming the innermost and outermost layers may be formed of a thermoplastic resin, a thermosetting resin, or the like. Preferably, a thermoplastic resin such as polyolefine, polyamide, or polyester is used. Among them, polyolefines such as polyethylene, polypropylene, ethylene-propylene copolymer, or polybutene-1 are preferred. Among these polyolefines, polyethylene is particularly preferred. Examples of polyethylene include high-density polyethylene, intermediate-density polyethylene low-density polyethylene, and linear-chain low-density polyethylene (hereinafter referred to as "mLLDPE"). Among them, low-density polyethylene and mLLDPE are particularly preferred.

The packaging material 11 dispensed from the dispenser section is intermittently fed, by means of an unillustrated feed apparatus, to a printing unit 38 via a guide roller 34, a feed roller 35, a tension roller 36, a bending roller 37, etc. At the printing unit 38, date of manufacture of packaging containers 33 and other data are printed in collective display sections of the packaging material 11. The packaging material 11, on which date of manufacture, etc. have been printed, is fed to a strip applicator 39, serving as a bonding apparatus. An elongated strip tape 12 is bonded and provisionally fixed to one edge eg1 of the packaging material 11 by means of the strip applicator 39. The strip applicator 39 includes a heater 14, which serves as a heating member for heating a portion of the edge eg1 of the packaging material 11 before the strip tape 12 is bonded thereto; a press roller 15, which serves as a press member for pressing the strip tape 12 against the edge eg1 of the packaging material 11; and guide rollers r1, r2, etc. which serve as a guide member for guiding the strip tape 12 dispensed from an unillustrated tape dispenser. Since the edge eg1 of the packaging material 11 is heated in advance, the strip tape 12 can be bonded to the packaging material 11 through a simple operation of the press roller 15 pressing the strip tape 12 against the packaging material 11. Accordingly, the press roller 15 functions as a bonding member.

The packaging material 11, onto which the strip tape 12 has been bonded, is fed to a sterilization tank 42 via bending rollers 40 and 41, and is sterilized by means of a sterilization solution, such as hydrogen peroxide, in the sterilization tank 42. Notably, reference numeral 43 denotes a bottom tray of the sterilization tank 42. Subsequently, the packaging material 11 is fed to an air knife 45 via a calendar roller 44. After being dried by means of the air knife 45, the packaging material 11 is gradually deformed into a tubular shape by means of an upper forming ring 48, a movable forming ring 49, a divided forming ring 50, and a lower forming ring 51. During this period, the packaging material 11 is longitudinally sealed by means of a longitudinal sealing apparatus 55, whereby a tubular packaging material 13 is formed, and a liquid food (contents), such as milk or juice, supplied via a supply pipe 52 is charged into the tubular packaging material 13.

Incidentally, when the packaging material 11 is formed in a tubular shape, opposite edges eg1 and eg2 of the packaging material 11 form steps inside and outside the tubular packaging material 13. If the liquid food soaks into packaging material 11 from an end surface of the packaging material 11 which forms the inside step as a result of the liquid food being charged into the tubular packaging material 13, the quality of packaging containers deteriorates. In view of this, the strip tape 12 is bonded and permanently fixed to the packaging material 11 across the step so as to prevent the end surface of the packaging material 11 from coming into contact with the liquid food.

The tubular packaging material 13 filled with the liquid food is guided and conveyed by means of a tube support ring 57 so as to be fed to a sealing-cutting apparatus 61, which serves as a lateral sealing apparatus and a cutting apparatus. The tubular packaging material 13 is nipped, laterally sealed, and cut at predetermined intervals by means of the sealing-cutting apparatus 61, whereby pillow-shaped prototype containers 23 are formed.

Subsequently, the prototype containers 23 are conveyed and formed into a predetermined shape by means of a final forming and conveying apparatus 58, whereby the above-mentioned packaging containers 33 each containing the liquid food in a constant amount are completed.

Next, the details of the strip applicator 39 will be described.

Figure 5:
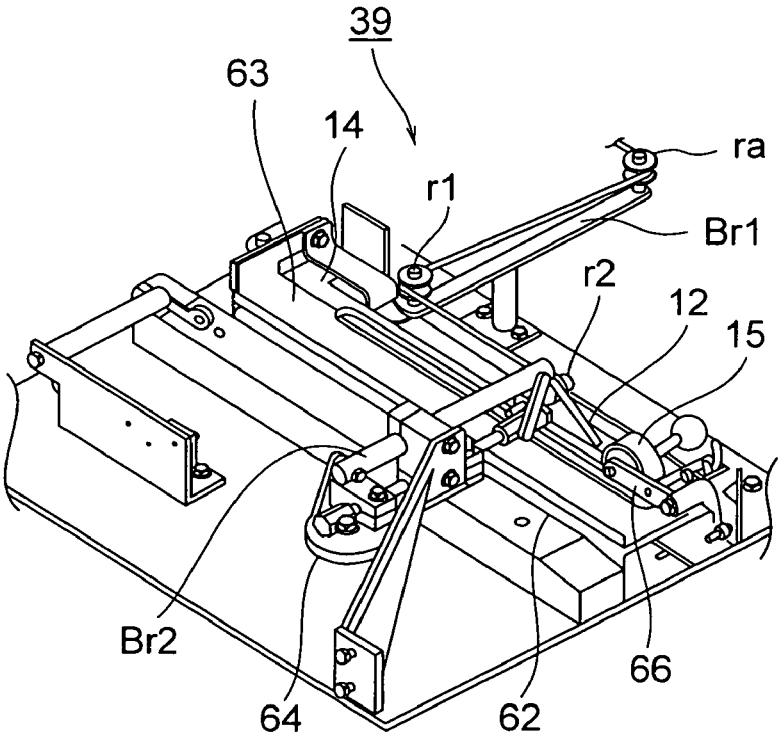
FIG. 5 is a perspective view of a strip-tape applicator used in the embodiment of the present invention.
Figure 6:
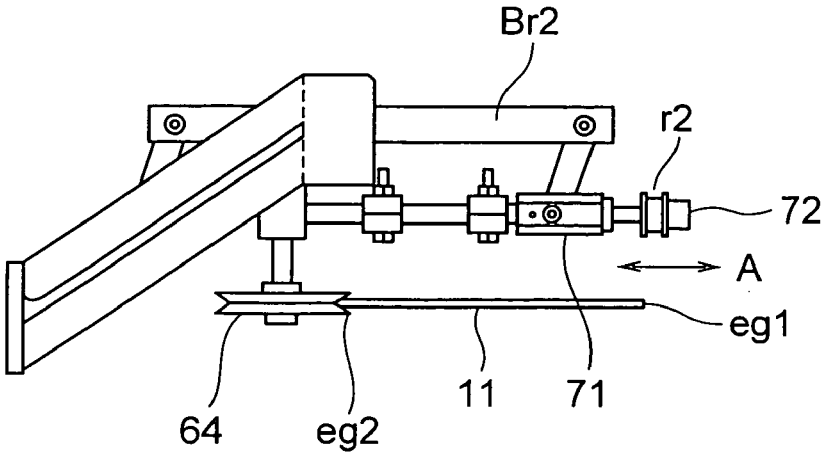
FIG. 6 is a front view of the strip-tape applicator used in the embodiment of the present invention.
Figure 7:
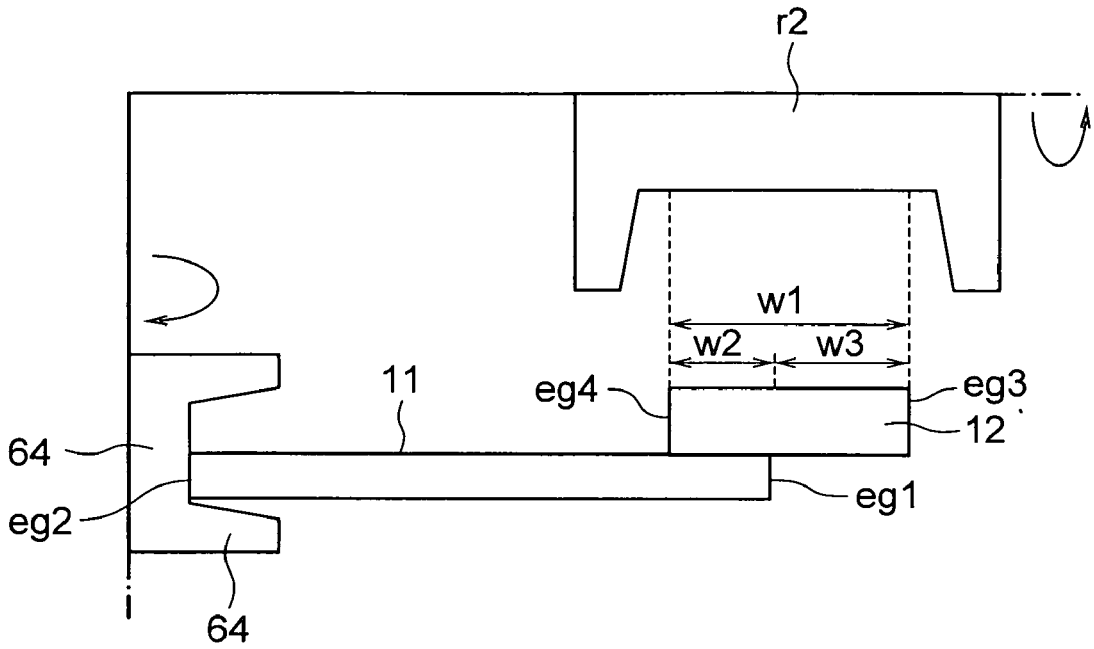
FIG. 7 is a front view relating to the embodiment of the present invention and showing a bonded state of a strip tape.
Figure 8:
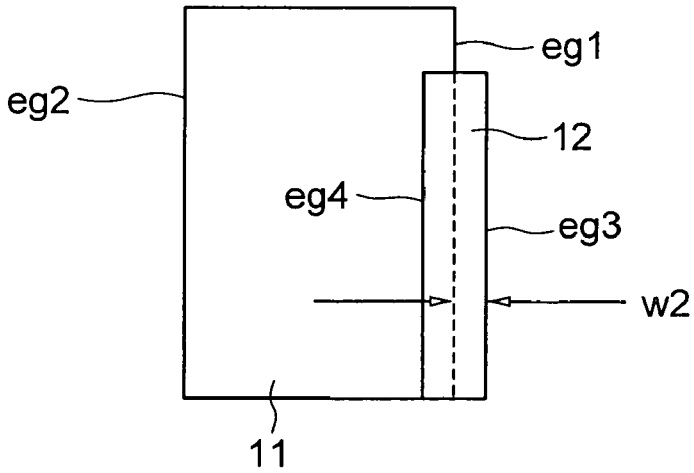
FIG. 8 is a plan view relating to the embodiment of the present invention and showing the bonded state of the strip tape.

FIG. 5 is a perspective view of the strip-tape applicator used in the embodiment of the present invention; FIG. 6 is a front view of the strip-tape applicator used in the embodiment of the present invention; FIG. 7 is a front view relating to the embodiment of the present invention and showing a bonded state of the strip tape; and FIG. 8 is a plan view relating to the embodiment of the present invention and showing the bonded state of the strip tape.

In these drawings, reference numeral 15 denotes the press roller; 39 denotes the strip applicator; 62 denotes a support frame which guides and supports the conveyed packaging material 11; and 63 denotes an upper frame which is disposed above the support frame 62 and guides the packaging material 11. The support frame 62 and the upper frame 63 form therebetween a conveyance passageway for conveying the packaging material 11. Reference numeral 64 denotes a guide roller serving as a guide member. The guide roller 64 is rotatably disposed in contact with the other edge eg2 of the packaging material 11. The guide roller 64 guides the packaging material 11 and sets a reference position for positioning the packaging material 11 in the width direction. The above-described heater 14 is disposed in the conveyance passageway in such a manner that it is located upstream of the press roller 15 and extends along the conveyance direction of the packaging material 11.

Reference symbol ra denotes a guide roller serving as a guide member. The guide roller ra guides the strip tape 12 dispensed from the tape dispenser, and changes its conveyance direction by 90°, whereby the strip tape 12 is conveyed toward the upper frame 63. Next, at a point immediately above the edge eg1 of the packaging material 11, the guide roller r1 changes the conveyance direction of the strip tape 12 by 90°, while guiding the strip tape 12, whereby the strip tape 12 is conveyed along the edge eg1 of the packaging material 11. Subsequently, while being guided by means of the guide roller r1, the strip tape 12 is conveyed obliquely downward toward the press roller 15. Notably, the guide rollers ra and r1 are supported by a bracket Br1, and the guide roller r2 is supported by a bracket Br2.

The above-mentioned press roller 15 is rotatably disposed at a distal end of an arm 66 swingably disposed on the upper frame 63. The press roller 15 presses the strip tape 12 against the packaging material 11 with a pressing force generated by means of an unillustrated pressing force adjustment unit. Further, an unillustrated support roller, serving as a receiving member, is rotatably disposed under the press roller 15 so as to support the packaging material 11 from the lower side thereof.

The guide roller 64 and the guide roller r1 are connected together by means of an unillustrated rotation transmission system. The rotational speed ratio, which represents the ratio in rotational speed between the guide roller 64 and the guide roller r1, is adjusted by means of the rotation transmission system, whereby the conveyance speeds of the packaging material 11 and the strip tape 12 become equal to each other when the packaging material 11 and the strip tape 12 come into mutual contact on the support frame 62. Accordingly, it is possible to prevent generation of tension or wrinkles in the strip tape 12, which would otherwise be generated with conveyance of the packaging material 11.

In the strip applicator 39 having the above-described structure, the packaging material 11 is guided by means of the support frame 62 and the upper frame 63 when it reaches the strip applicator 39. At that time, the edge eg1 of the packaging material 11 is heated by means of the heater 14. Meanwhile, the strip tape 12 is pressed against the packaging material 11 by the press roller 15 after being guided by the guide rollers ra, r1, and r2, whereby the strip tape 12 receives heat from the packaging material 11 and is welded to the packaging material 11.

Incidentally, since the packaging material 11 is not necessarily cut to have accurate dimensions, the position of edge eg1 of the conveyed packaging material 11 changes in some cases, despite the fact that the position of the edge eg2 of the packaging material 11 is restricted by means of the guide roller 64. In such a case, the strip tape 12 cannot be bonded to the packaging material 11 at a proper position unless the strip tape 12 is placed at a proper position in relation to the packaging material 11.

Further, as the strip tape 12 is dispensed from the holder hd (see FIG. 1) by means of the dispenser, the reel diameter of the strip tape 12 in the holder hd changes. Such a change in the reel diameter results in a change in tension applied to the strip tape 12, with a resultant movement of the strip tape 12 in the width direction. In such a case, the strip tape 12 cannot be bonded to the packaging material at a proper position unless the strip tape 12 is placed at a proper position in relation to the packaging material 11.

Moreover, since the strip tape 12 is formed of thin resin film, as a result of the strip tape 12 being dispensed, the edges eg3 and eg4 of the strip tape 12 extend and wave, whereby the strip tape 12 meanders and moves in the width direction. In such a case, the strip tape 12 cannot be bonded to the packaging material 11 at a proper position unless the strip tape 12 is placed at a proper position in relation to the packaging material 11.

For example, when the width of the strip tape 12 (i.e., tape width) is represented by w1, a width over which the strip tape 12 is bonded to the packaging material 11 (i.e., bonding width) is represented by w2, and a width of a portion of the strip tape 12 projecting from the packaging material 11 (i.e., projection width) is represented by w3, the bonding width w2 is equal to the distance between the edges eg1 and eg4, and the projection width w3 is equal to the distance between the edges eg1 and eg3.

In the present embodiment, in a case where the tape width w1 is 7.5 mm, a proper value of the bonding width w2 is mm, and a proper value of the projection width w3 is mm. However, if the position of the edge eg2 of the packaging material 11 changes or the strip tape 12 moves in the width direction as described above, the projection width w3 changes within the range of 4.25±0.65 mm, and an error of +0.65 mm is produced.

In view of this, in the present embodiment, the position of the strip tape 12 in relation to the packaging material 11 is detected, and the position of the strip tape 12 is controlled in such a manner that the projection width w3 falls within a preset range. For such control, a drive section 71 for position adjustment is disposed so as to move the guide roller r2 along an axial direction (a direction of arrow A in FIG. 6), and a shaft 72 of the guide roller r2 is moved by means of the drive section 71. Notably, a linear motor or a combination of a step motor, a ball screw, etc. can be used as the drive section 71.

Figure 9:
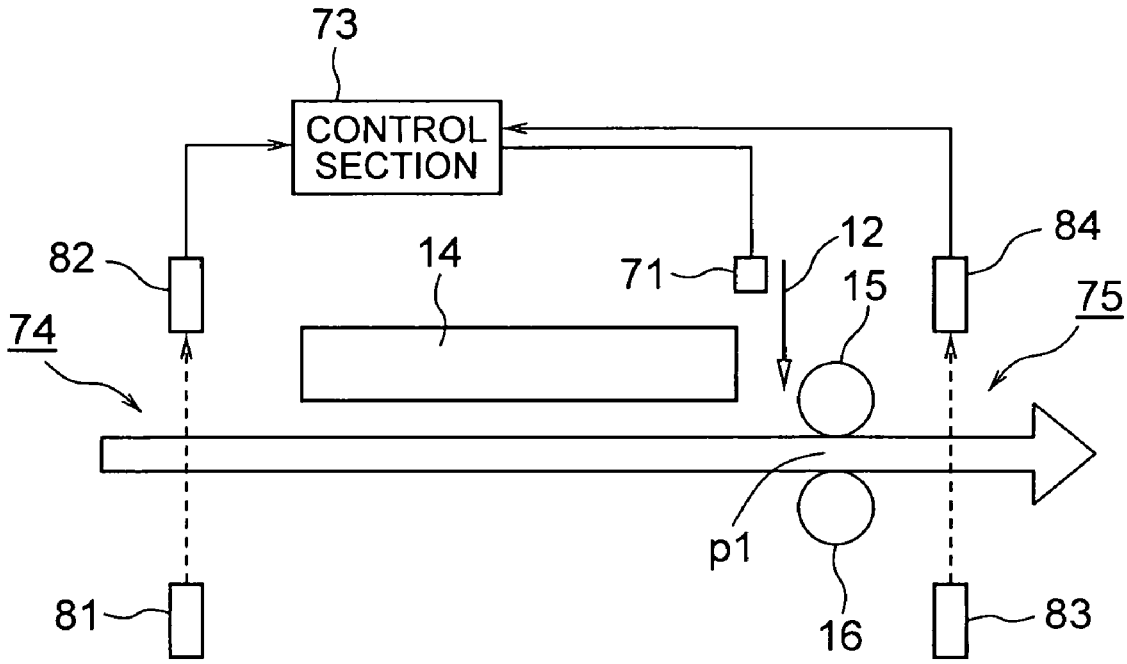
FIG. 9 is a schematic diagram of a strip-tape-position control apparatus used in the embodiment of the present invention.
Figure 10:
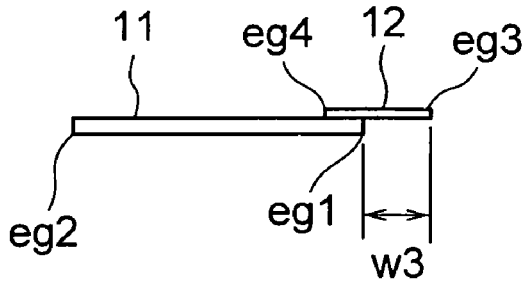
FIG. 10 is a first view used for explaining the operation principle of an edge detection apparatus used in the embodiment of the present invention.
Figure 11:
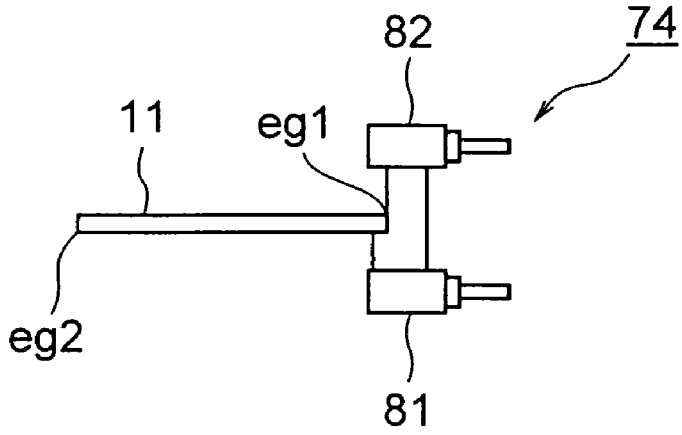
FIG. 11 is a second view used for explaining the operation principle of the edge detection apparatus used in the embodiment of the present invention.
Figure 12:
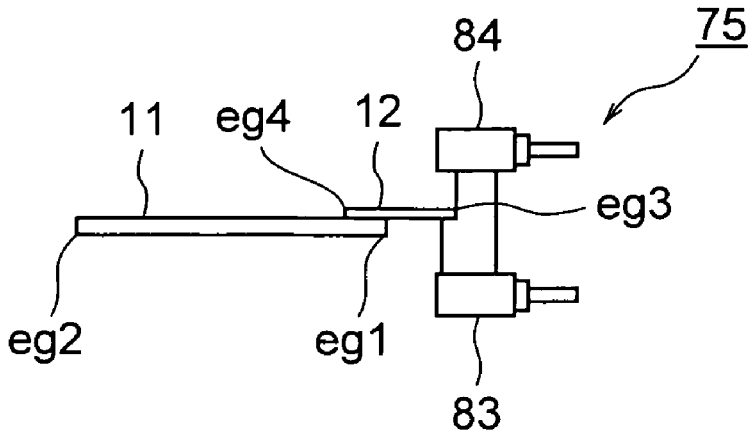
FIG. 12 is a third view used for explaining the operation principle of the edge detection apparatus used in the embodiment of the present invention.

FIG. 9 is a schematic diagram of a strip-tape-position control apparatus used in the embodiment of the present invention; FIG. 10 is a first view used for explaining the operation principle of an edge detection apparatus used in the embodiment of the present invention; FIG. 11 is a second view used for explaining the operation principle of the edge detection apparatus used in the embodiment of the present invention; and FIG. 12 is a third view used for explaining the operation principle of the edge detection apparatus used in the embodiment of the present invention.

In FIG. 9, an arrow indicates the conveyance direction of the packaging material 11. Reference numeral 12 denotes the strip tape, 14 denotes the heater, 15 denotes the press roller, and 16 denotes the support roller. A pressing portion p1 is formed between the press roller 15 and the support roller 16. Further, reference numeral 71 denotes the drive section, 73 denotes a control section, 74 denotes an edge sensor serving as a first detection section, and 75 denotes an edge sensor serving as a second detection section. The edge sensor 74 is disposed upstream of the pressing portion p1 with respect to the conveyance direction of the packaging material 11 to sandwich the packaging material 11. The edge sensor 75 is disposed downstream of the pressing portion p1 with respect to the conveyance direction of the packaging material 11 to sandwich the packaging material 11.

The edge sensor 74 is composed of an optical sensor and includes a light emission section (first detection element) 81 disposed under the packaging material 11 and in the vicinity of the edge eg1 of the packaging material 11, and a light reception section (second detection element) 82 disposed above the packaging material 11 to face the light emission section 81. As shown in FIG. 11, a light beam having a predetermined width in the width direction of the packaging material 11 is emitted from the light emission section 81. A portion of the light beam hits the edge eg1 of the packaging material 11 and is blocked thereby, and the remaining portion of the light beam reaches the light reception section 82.

The edge sensor 75 is composed of an optical sensor and includes a light emission section (first detection element) 83 disposed under the packaging material 11 and the strip tape 12 to be located in the vicinity of the unbonded-side edge eg3 of the strip tape 12, and a light reception section (second detection element) 84 disposed above the packaging material 11 and the strip tape 12 to face the light emission section 83. As shown in FIG. 12, a light beam having a predetermined width in the width direction of the packaging material 11 is emitted from the light emission section 83. A portion of the light beam hits the edge eg3 of the strip tape 12 and is blocked thereby, and the remaining portion of the light beam reaches the light reception section 84.

Unillustrated edge detection processing means (an edge detection processing section) of the control section 73 performs edge detection processing so as to read an output of the light reception section 82, detect the edge eg1 of the packaging material 11, read an output of the light reception section 84, and detect the edge eg2 of the strip tape 12.

Subsequently, unillustrated projection-width calculation processing means (a projection-width calculation processing section) of the control section 73 performs projection-width calculation processing so as to calculate the projection width w3 from the relation between the edges eg1 and eg3; and unillustrated bonding-width calculation processing means (a bonding-width calculation processing section) of the control section 73 performs bonding-width calculation processing so as to calculate the bonding width w2 by subtracting the projection width w3 from the tape width w1 of the strip tape 12.

Unillustrated position determination processing means (a position determination processing section) of the control section 73 then performs position determination processing so as to determine the position of the strip tape 12 in relation to the packaging material 11. For this determination, the position determination processing means compares the projection width w3 with a set value and determines whether or not the projection width w3 falls within a predetermined range, to thereby judge whether or not the strip tape 12 is placed at a proper position in relation to the packaging material 11.

Subsequently, unillustrated position correction processing means (a position correction processing section) of the control section 73 performs position correction processing so as to correct the position of the strip tape 12 in relation to the packaging material 11 on the basis of results of the position determination by the position determination processing. That is, when the projection width w3 does not fall within the predetermined range and the strip tape 12 is not placed at a proper position in relation to the packaging material 11, the position correction processing means drives the drive section 71 so as to move the shaft 72 to thereby adjust the position of the guide roller r2 such that the projection width w3 falls within the predetermined range and the strip tape 12 is placed at a proper position in relation to the packaging material 11.

As described above, since the strip tape 12 is placed at a proper position in relation to the packaging material 11, the strip tape 12 can be bonded to the packaging material 11 at a proper position. Accordingly, longitudinal sealing can be performed well.

The present invention is not limited to the above-described embodiments. Numerous modifications and variations of the present invention are possible in light of the spirit of the present invention, and they are not excluded from the scope of the present invention.

INDUSTRIAL APPLICABILITY

The present invention is applicable to a packaging-container manufacturing apparatus for manufacturing packaging containers containing liquid food.

The invention claimed is:

1. A packaging-container manufacturing apparatus characterized by comprising:

(a) a bonding member which bonds a strip tape to one edge of a weblike packaging material;

(b) a first detection section disposed upstream of the bonding member with respect to a conveyance direction of the packaging material and adapted to detect the edge of the packaging material;

(c) a second detection section disposed downstream of the bonding member with respect to the conveyance direction of the packaging material and adapted to detect an edge of the strip tape;

(d) position determination processing means for determining the position of the strip tape in relation to the packaging material on the basis of outputs of the first and second detection sections; and (e) position correction processing means for correcting the position of the strip tape in relation to the packaging material on the basis of results of the determination on the position.

2. A packaging-container manufacturing apparatus according to claim 1, wherein the first detection section is disposed to sandwich the packaging material, and the second detection section is disposed to sandwich the strip tape.

3. A packaging-container manufacturing apparatus according to claim 1, further comprising:

(a) projection-width calculation processing means for calculating a projection width, which is the width of a portion of the strip tape projecting from the packaging material, on the basis of the outputs of the first and second detection sections, wherein (b) the position determination processing means determines the position of the strip tape in relation to the packaging material on the basis of the projection width.

4. A packaging-container manufacturing apparatus according to claim 1, further comprising:

(a) a guide member which guides the strip tape; and (b) a drive section which moves the guide member, wherein (c) the position correction processing means drives the drive section on the basis of the results of the determination on the position.

5. A packaging-container manufacturing method in which a strip tape is bonded to one edge of a weblike packaging material by means of a bonding member, the method being characterized by comprising:

(a) detecting the edge of the packaging material upstream of the bonding member with respect to a conveyance direction of the packaging material;

(b) detecting an edge of the strip tape downstream of the bonding member with respect to the conveyance direction of the packaging material;

(c) determining the position of the strip tape in relation to the packaging material on the basis of outputs of first and second detection sections; and (d) correcting the position of the strip tape in relation to the packaging material on the basis of results of the determination on the position.

* * * * *